United States Patent [19]

Kircher

[11] 4,315,810

[45] Feb. 16, 1982

[54] ELECTRODE FOR MONOPOLAR FILTER PRESS CELLS

[75] Inventor: Morton S. Kircher, Clearwater, Fla.

[73] Assignee: Olin Corporation, New Haven, Conn.

[21] Appl. No.: 157,902

[22] Filed: Jun. 9, 1980

Related U.S. Application Data

[63] Continuation-in-part of Ser. No. 128,684, Mar. 10, 1980.

[51] Int. Cl.[3] ..... C25B 9/04; C25B 11/03; C25B 11/00

[52] U.S. Cl. ..... 204/257; 204/284; 204/288; 204/289; 204/263; 204/269

[58] Field of Search ..... 204/252–253, 204/257–258, 263–266, 279, 286, 288–289, 284, 283

[56] References Cited

U.S. PATENT DOCUMENTS

| | | | |
|---|---|---|---|
| 3,932,261 | 1/1976 | Kircher et al. | 204/288 |
| 3,963,595 | 6/1976 | Danna | 204/288 X |
| 4,008,143 | 2/1977 | Kircher et al. | 204/288 X |
| 4,026,785 | 5/1977 | Ford | 204/288 X |
| 4,056,458 | 11/1977 | Pohto et al. | 204/263 |
| 4,210,516 | 7/1980 | Mose et al. | 204/284 |
| 4,211,627 | 7/1980 | Cunningham | 204/254 X |

FOREIGN PATENT DOCUMENTS

| | | | |
|---|---|---|---|
| 2023181 | 12/1979 | United Kingdom | 204/252 |

*Primary Examiner*—Delbert E. Gantz
*Assistant Examiner*—Donald R. Valentine
*Attorney, Agent, or Firm*—James B. Haglind; Donald F. Clements

[57] ABSTRACT

A novel electrode for a monopolar filter press cell is disclosed which comprises a first foraminous surface and a second foraminous surface positioned in parallel and spaced apart, which are secured to conductor rods positioned in a cell frame. The frame has two side members, a top member and a bottom member attached to the first and second foraminous surfaces. A chamber is formed between the first and second foraminous surfaces and bounded by the frame. At least one pair of conductor rods pass through one of the side members of the frame into the chamber. One of the conductor rods in each pair is attached only to the first foraminous surface; the other conductor rod in the pair is attached only to the second foraminous surface. The frame has inlets and outlets for introducing fluids into and removing electrolysis products from the chamber. The novel electrode provides controlled fluid flow up through the electrode chamber to be maintained at desired rates while controlling the ratio of liquid to gas in the upper portion of the electrode to minimize or eliminate foam formation in the cell.

11 Claims, 4 Drawing Figures

ELECTRODE FOR MONOPOLAR FILTER PRESS CELLS

This application is a continuation-in-part of application U.S. Ser. No. 128,684, filed Mar. 10, 1980.

This invention relates to novel electrodes for membrane type electrolytic cells and particularly to electrodes for monopolar filter press cells.

Commercial cells for the production of chlorine and alkali metal hydroxides have been continually developed and improved over a period of time dating back to at least 1892. In general, chloralkali cells are of the deposited asbestos diaphragm type or the flowing mercury cathode type. During the past few years, developments have been made in cells employing ion exchange membranes (hereafter "membrane cells") which promise advantages over either diaphragm or mercury cells. It is desirable to take advantage of existing technology particularly in diaphragm cells, but it is also necessary to provide cell designs which meet the requirements of the membranes. Since suitable membrane materials such as those marketed by E. I. duPont de Nemours and Company under the trademark Nafion® and by Asahi Glass Company Ltd. under the trademark Flemion® are available principly in sheet form, the most generally used of the membrane cells are of the "filter press" type. In the filter press type of cell, membranes are clamped between the flanges of filter press frames. Filter press cells are usually of the bipolar type. Bipolar filter press cells have been found to have several disadvantages, such as (a) corrosion between connections from anodes to cathodes through the separating plate; and (b) electrical leakage from one cell to another through inlet and outlet streams.

Furthermore, bipolar cell circuits designed for permissible safe voltages of about 400 volts are small in production capacity and are not economical for a large commercial plant. The failure of one cell in a bank of bipolar filter press cells normally requires shutting down the entire filter press bank.

Filter press cells of monopolar design are not well known, probably because of the substantial practical problem of making electrical connections between the unit frames in the filter press and between one cell and the next. Tying all of the anodes together with a single electrical bus and tying all of the cathodes together with a single electrical bus interferes with drawing the frames together to form the seal between frames and membranes. On the other hand, use of flexible cables from cell to cell provides no way of removing one cell at a time from the circuit without interrupting the current for the entire circuit.

To illustrate the awkwardness of previous attempts to design monopolar membrane cells, reference is made to U.S. Pat. No. 4,056,458, by Pohto et al issued Nov. 2, 1977, to Diamond Shamrock Corporation. The Pohto et al patent discloses a cell which, like bipolar filter press cells, has the electrodes and end plates oriented perpendicular (see FIG. 8 of Pohto et al) to the overall path of current flow through the cell. Specifically, Pohto et al discloses a central electrode assembly sandwiched between two end electrode assemblies, with membranes in between, to form a closed cell. A plurality of central electrode assemblies apparently may also be sandwiched in a similar manner. The end compartment and each of the center compartments of the cell of Pohto et al are flanged and maintained paired by gaskets and fasteners holding flanges in pairs. This type of cell may be practical for small units producing several hundred pounds of chlorine per day, but it is not economically practical for plants which produce several hundred tons per day. For example, Pohto et al disclose connecting the cells to bus bars in a system which would only be suitable economically on a small scale. Specifically, electrode rods extend from the cell tops. This includes rods of both polarities. If one tries to design such a bus system for a cell having a total current capacity of at least 150,000 amperes which is a typical commercial cell current, the bus system will be found to be very large, cumbersome, and expensive.

Monopolar filter press cells which have the electrodes oriented to provide a horizontal path of current flow through the cell have significant advantages over those providing a vertical current path through the cell. In these "side-stack" cells, the electrode elements and membranes are formed into a stack of "electrode packs" which are bolted between end frames. An electrode pack includes a pair of electrodes of opposite polarity separated by a diaphragm or membrane. The end frames support the pack to form a convenient unit with respect to capacity, floor space, and portability. As the number of units in the stack are usually limited to less than about 50, problems with leakage are greatly reduced. Also virtually eliminated are problems with deformation of connecting bus bars due to temperature changes, which are serious with conventional filter press cells. Another advantage of the monopolar filter press cell is that, in case of failure of a membrane, only a single cell including less than about 50 membranes need be removed for dismantling, repair and reassembly. This is more economical than either taking out the entire filter press assembly on the one hand or providing an expensive arrangement for replacing individual membranes on the other hand. Still another advantage is that electrode structures having horizontally oriented conductors permit the construction of an extraordinarily high cell, while maintaining a short direct current path through the cell, thereby minimizing the amount of conductor material required for the cell and thereby minimizing voltage losses through the conductors of the cell. Yet another advantage of sidestack cells is that they employ intercell electrical connections which make taking a cell out of service relatively fast and simple.

Electrode structures with horizontally oriented conductors for diaphragm or membrane cells of the prior art include that of U.S. Pat. Nos. 3,932,261, issued Jan. 13, 1976, and U. S. Pat. No. 4,008,143, issued Feb. 15, 1977, to M. S. Kircher and J. A. Wood. This electrode structure has at least two conductive supports attached to a vertically positioned electrode plate. One conductive support is attached to one of two electrode surfaces; the conductive supports being perpendicular to the electrode plate.

In a filter press cell, the electrodes include a frame which is limited in thickness so that the cell can accommodate a plurality of intermeshed anodes and cathodes to provide maximum production of electrolysis products within the designated cell area.

It is an object of the present invention to provide a novel electrode for monopolar filter press cells having electrodes extending in a direction parallel to the path of current flow through the cell.

Another object of the present invention is to provide an electrode for monopolar filter press cells having a high rate of gas release in the absence of vibrations or violent pressure fluctuations.

An additional object of the present invention is to provide an electrode for monopolar filter press cells which maintains a desired ratio of gas to liquid in the upper portion of the electrode to minimize foam formation.

A further object of the present invention is to provide an electrode which permits an efficient electrical connection to intercell current conductors.

A still further object of the present invention is to provide an electrode for monopolar filter press cells which can be readily fabricated.

These and other objects of the invention which will be apparent can be accomplished in an electrode for a monopolar filter press cell which comprises:

(a) a first foraminous surface and a second foraminous surface positioned in parallel and spaced apart;

(b) a frame having two side members, a top member and a bottom member attached to the first foraminous surface and the second foraminous surface;

(c) a chamber formed between the first foraminous surface and the second foraminous surface and bounded by the frame;

(d) at least one pair of conductor rods entering said chamber through openings in one of the side members of the frame, one of said pair of conductor rods being attached only to the first foraminous surface and the other of said pair of conductor rods being attached only to the second electrode surface, each conductor rod having a lead portion outside of the chamber suitable for attachment to a current supply means and a support portion inside the chamber for attachment to the electrode surface, and (e) inlets and outlets in the frame for introducing fluids into and removing electrolysis products from the chamber.

Other advantages of the invention will become apparent upon reading the description below and the invention will be better understood by reference to the attached drawings in which.

Figures 1, 2, 3, 4:
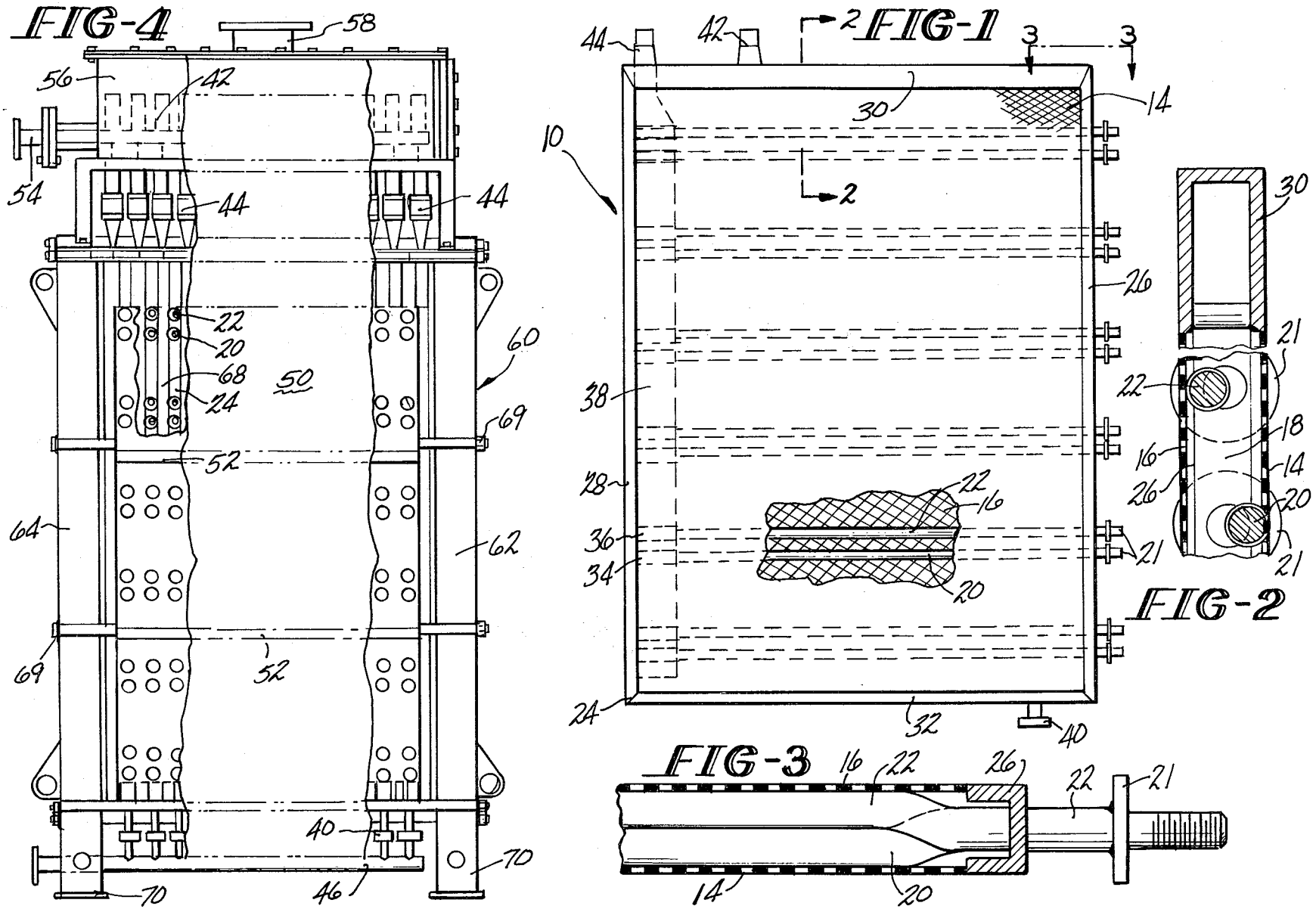
FIG. 1 illustrates a front view of the electrode of the present invention with portions cut away.
FIG. 2 depicts an end view of a partial section of the electrode of FIG. 1 taken along line 2—2 showing the conductor rods attached to the electrode surface.
FIG. 3 represents a top view of a partial section of the electrode of FIG. 1 taken along line 3—3.
FIG. 4 shows a side view of a monopolar filter press cell employing the electrodes of the present invention.

Electrode 10 of FIGS. 1–3 is comprised of foraminous electrode surfaces 14 and 16 positioned in parallel and spaced apart. Frame 24 is comprised of side members 26 and 28, top member 30, and bottom member 32. Foraminous surfaces 14 and 16 are attached to frame 24 to form chamber 18 between foraminous surfaces 14 and 16 bounded by frame 24. Pairs of conductor rods 20 and 22 pass through openings (not shown) in side member 26 into chamber 18. Conductor rods 20 are welded to foraminous electrode surface 14 and conductor rods 22 are welded to foraminous electrode surface 16. Conductor rods 20 and 22 having flanges 21 at one end, traverse electrode surfaces 14 and 16, respectively, and are welded at the opposite end of the electrode surfaces to one end of bars 34 and 36, respectively. The other end of bars 34 and 36 is welded to side frame member 28. One side of bars 34 is welded to electrode surface 14 and the opposite side to downcomer pipe 38. Similarly attached to electrode surfaces 16 and downcomer pipe 38 are bars 36. Electrode 10 has liquid inlet 40, product outlet 42 and liquid inlet 44 which is connected to downcomer pipe 38. Gaskets or other sealant materials are suitably placed around the electrode frame to permit a series of interleaved anodes and cathode frames to be sealingly compressed to form monopolar filter press cell 60 (see FIG. 4).

In the end view of the partial section shown in FIG. 2, conductor rod 20 enters an opening (not shown) in the center of frame side member 26 and is bent or offset toward electrode surface 20 to which it is attached. Similarly, conductor rod 22 is bent toward electrode surface 16.

FIG. 3 shows conductor rod 22 passing through an opening (not shown) in frame 26. Conductor rod 22 is bent toward and attached to electrode surface 16. Conductor rod 20 alined directly below conductor rod 22 is bent toward and attached to electrode surface 14.

Monopolar filter press cell 60, illustrated in FIG. 4, comprises a plurality of interleaved anode frames 24 and cathode frames 68 compressingly held between front end plate 62 and a rear end plate 64 by a plurality of tie bolts 69. Conductor rods 20 and 22 are bolted to anode collectors 50 to which electric current is supplied through anode terminals 52. Anolyte feed pipe 54 supplies fresh anolyte to inlets 44 housed in anolyte disengager 56. Electrolysis products enter anolyte disengager 56 through outlets 42 and product gases are removed through outlet 58.

Cell 60 is supported on support legs 70 and is provided with an anolyte drain/inlet line 46. Line 46 can be a valved drain line connected to bottom member 32 of each of anode frames 24 by inlets 40 to allow anolyte to be drained. Alternatively, line 46 can be connected to anolyte disengager 56 in order to provide a recirculation path for disengaged anolyte liquid.

More in detail, the novel electrodes of the present invention include at least one pair of conductors, each of which is attached to only one electrode surface. Preferably, several pairs of conductor rods are attached to each electrode surface, for example, from about 2 to about 12. The employment of the conductor rods in pairs permits spatial arrangements of the conductor rods to provide the desired rates of fluid flow through the electrode chamber. As shown in FIGS. 1 and 2, one conductor rod of each pair is attached to the first electrode surface and the other conductor rod is attached to the second electrode surface. Thus, each electrode surface is independent of the other with respect to the receipt or removal of electric current. Each conductor rod has a lead portion which is outside of the frame and which is connected to or attached to a current supply means such as electrode collectors and/or electrode terminals. This lead portion is normally attached so that it is perpendicular to the current supply means and is substantially horizontal between the current supply means and the openings in the side frame member. The conductor rods pass through the openings in the side frame and into the electrode chamber. The openings for each pair of connector rods may be arranged in any suitable manner such as side by side, staggered or vertical. In order to minimize the thickness of the frame, it is preferred to place the openings substantially in the center of the frame and more preferably to align them vertically. Centering of the openings permits, for example, the electrode collector to be narrow strips and results in a cost reduction for materials. When the openings in the side frame are centered, the conductor rods are bent or offset towards the electrode surface to which they are attached. Vertical alignment, as shown in FIGS. 2 and 3, allows a pair of conductor rods to be placed in close proximity with non-interference of the electrical connections. The rods are staggered and spaced apart a distance of, for example, from about 0.025 to about 0.100 meters, as measured between openings in the side frame. Within the electrode chamber, the support portion of the conductor rod is directly attached to an electrode surface to conduct electric current to or from the electrode surface and to provide mechanical support to the electrode surfaces. In addition to possibly being bent or offset in a lateral direction, the support portion of the conductor rod may be sloped or curved upward or downward if desired. The slope or curvature of the support portion may be, for example, from about 1 to about 30, and preferably from about 2 to about 10 degrees from the horizontal, referenced from the lead portion of the conductor rod. To provide low resistance electrical connections, the support portion of the conductor rods are directly attached to the electrode surface, for example, by welding or brazing.

While the term conductor rod has been employed, the conductors may be in any convenient physical form such as rods, bars, or strips. Rods having a circular cross section are preferred, however, other shapes such as flattened rounds, elipses, etc. may be used.

Conductor rods are selected so that the sum of the diameters of a pair of conductor rods is equal to from about 50 to about 180 percent of the thickness of the chamber. Individually, the rods have a diameter of from about 6 to about 75, and preferably from about 12 to about 25 millimeters. While each of the conductor rods in a pair may have a different diameter, it is preferred that for a given pair of conductor rods, the diameter be the same. Conductor rods in adjacent pairs may have the same or different diameters.

Placement of the rods along the electrode surfaces provides a channel through which the flow of fluids is provided with a clear but restricted path. Where the conductor rods are in the preferred staggered arrangement, as shown in FIGS. 1 and 2, the fluids are forced to take a serpentine path which tends to form larger gas bubbles and increases the rate of gas separation. Increased rates of gas separation, in turn, leads to a lower gas fraction in the electrolyte, and a lower cell voltage. Where the gas and liquid flow around the conductor rods, a "Venturi" effect is created by providing a low pressure zone. Electrolyte and electrolysis are drawn through the electrode surface from the interelectrode gap and impingement of the gases on the membrane is reduced or prevented. This is particularly important, for example, where the electrodes are employed as anodes in the electrolysis of alkali metal chloride brines, as the impingement of chlorine gas against the membrane tends to reduce membrane life.

Where the electrodes of the present invention are employed as anodes, for example, in the electrolysis of alkali metal chloride brines, the conductor rods are suitably fabricated from a conductive metal such as copper, silver, steel, magnesium, or aluminum covered by a chlorine-resistant metal such as titanium or tantalum. Where the electrodes serve as the cathodes, the conductor rods are suitably composed of, for example, steel, nickel, copper, or coated conductive materials such as nickel coated copper.

The electrode surfaces for the electrode of the present invention are those which are employed in commercial cells, for example, for the production of chlorine and alkali metal hydroxides by the electrolysis of alkali metal chloride brines. Typically, electrode surfaces which serve as the anode in these cells is comprised of a valve metal such as titanium or tantalum. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms, for example, a screen, mesh, perforated plate, or an expanded mesh which is flattened or unflattened, and having slits horizontally, vertically, or angularly. Other suitable forms include woven wire cloth, which is flattened or unflattened, bars, wires, or strips arranged, for example, vertically, and sheets having perforations, slits, or louvered openings.

A preferred anode surface is a foraminous metal mesh having good electrical conductivity in the vertical direction along the anode surface.

As the cathode, the electrode surface is suitably a metal screen or mesh where the metal is, for example, iron, steel, nickel, or tantalum, with nickel being preferred. If desired, at least a portion of the cathode surface may be coated with a catalytic coating such as Raney nickel or a platinum group metal, oxide, or alloy as defined above.

As shown in FIG. 1, frame 24 surrounds and encloses the electrode surfaces. It will be noted that, for example, the electrode frames are shown to be of a picture-frame type configuration with four peripheral members. These members could be in the shape of rectangular bars, "U"-shaped channels, circular tubes, elliptical tubes as well as being I-shaped or H-shaped. An inverted "U"-shaped channel construction is preferred for the top member in order to allow the top member to serve as a gas collector. Preferably, this top inverted channel is reinforced at its open bottom to prevent bending, buckling, or collapse. The remaining members could be of any suitable configuration which would allow the frames to be pressed together against a gasket in order to achieve a fluid-tight cell. While a flat front and rear surface is shown for the members, it would be possible to have many other configurations such as round or even ridged channels. The electrode surface is shown in FIG. 1 to be welded to the inside of the peripheral members of the frame but could be welded to the front and back outside surfaces if the configuration of such outside surfaces did not interfere with gasket sealing when the electrode surfaces were on the outside rather than inside.

With the possible exception of the selection of materials of construction, frames 24 may be employed as anode frames or cathode frames in the electrodes of the present invention.

Separators which may be used in electrolytic cells employing the electrodes of the present invention include porous diaphragms such as those comprised of asbestos fibers or asbestos fibers modified with polymers such as polytetrafluoroethylene, polyvinylidene fluoride, polyacrylic acid, or perfluorosulfonic acid resins. However, preferred as separators are ion exchange membranes.

Membranes which can be employed with the electrodes of the present invention are inert, flexible membranes having ion exchange properties and which are impervious to the hydrodynamic flow of the electrolyte and the passage of gas products produced in the cell. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. duPont de Nemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic acid compound as described, for example, in U.S. Pat. No. 4,138,373, issued Feb. 6, 1979, to H. Ukihashi et al. A second method of producing the above-described cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable group which can be converted to carboxyl groups. Carboxylic acid type cation exchange membranes are available commercially from the Asahi Glass Company under the trademark "Flemion".

Spacers may be placed between the electrode surfaces and the membrane to regulate the distance between the electrode and the membrane and, in the case of electrodes coated with platinum group metals, to prevent direct contact between the membrane and the electrode surface.

The spacers between the membrane and the electrode surfaces are preferably electrolyte-resistant netting having openings which are preferably about $\frac{1}{4}''$ in both the vertical and horizontal directions so as to effectively reduce the interelectrode gap to the thickness of the membrane plus two thicknesses of netting. The netting also restricts the vertical flow of gases evolved by the electrode surfaces and drives the evolved gases through the mesh and into the center of the hollow electrodes. That is, since the netting has horizontal as well as vertical threads, the vertical flow of gases is blocked by the horizontal threads and directed through the electrode surfaces into the space between the electrode surfaces. With a $\frac{1}{4}''$ rectangular opening in the netting, the effective cell size in the interelectrode gap is reduced to about $\frac{1}{4}'' \times \frac{1}{4}''$.

The novel electrodes of the present invention provide improved gas flow patterns by creating limited restrictions within the space between electrode surfaces of each electrode so as to generate a Venturi or low pressure effect which pulls the gases from the interelectrode gap through the electrode surfaces and into the interior of the electrodes. Simultaneously with the Venturi effect, coalescence expands small bubbles into large bubbles. The large bubbles rise more rapidly through the electrode chamber than the liquid, thus requiring a smaller volume fraction. The novel electrodes of the present invention promote the rapid release of gas so that the fraction of gas in the fluid may be maintained below 30 percent, preferably below 20 percent, and more preferably in the range of from about 5 to about 15 percent by volume. These low ratios of gas to liquid in the fluid minimize or eliminate foam formation in the electrode. Placement of the conductor rods along the electrode surfaces provides for the electrode chamber to be divided into stages with restriction of fluid flow between stages. This provides for the controlled coalescence of bubbles and eliminates or significantly reduces vibrations by avoiding violent pressure fluctuations which would occur in electrodes of the prior art.

The electrodes of the present invention are particularly suited for use in filter press cells employing electrodes which are from about 1 to about 5 meters high, and 0.010 to about 0.100 meters thick, and preferably from about 1.5 to about 3 meters high, and from about 0.025 to about 0.065 meters thick. The ratio of height to thickness is in the range of about 10:1 to about 80:1 and preferably from about 20:1 to about 50:1. For cells where the total number of electrode packs in the pressed stack is in the range of from about 5 to about 50, this provides a ratio of height to thickness of the cell of at least about 1:2, and preferably at least 2:1. Significant increases in the ratio of units of product per area of floor space can be achieved with filter press cells of this type.

To further illustrate the novel electrode of the present invention, the following example is presented without any intention of being limited thereby.

EXAMPLE

A monopolar filter press cell of the type of FIG. 4 contained one anode interleaved between two cathode end-sections having only one mesh surface each. A cation exchange membrane separated the anode from the cathodes. The electrodes were 2.0 meters high, 1.5 meters wide, and had an electrode surface area of 6.0 square meters. The anode was 0.04 meters thick and had a height to thickness ratio of 50:1.

The anode was of the type of FIGS. 1–3 comprised of two mesh surfaces spaced apart 0.038 meters and welded to the inside of a titanium frame having a top member, a bottom member and two side members. A total of 5 pairs of conductor rods supplied electric current to the electrode surfaces. The conductor rods were bolted to an anode collector to which electric current was supplied through an anode terminal. Each pair of conductor rods was aligned vertically, spaced apart on 0.056 meter centers, with each adjacent pair being spaced apart on 0.33 meter centers. The anode conductor rods were titanium clad copper rods 0.019 meters in diameter which passed through openings centered in a side frame member. Of each pair of rods, the support portion was bent towards the electrode surface to which it was welded as illustrated in FIG. 3. The lead and support portion of the conductor rods were substantially horizontal and traversed the length of the electrode surface. Sodium chloride brine (310–320 grams per liter of NaCl) was fed to the anode through an inlet in the bottom frame member. The brine was electrolyzed with electric current at 12 KA corresponding to a current density of 2.0 KA per square meter. The cell operated at a typical voltage of 3.8 and a current efficiency of 93 percent. Recirculation of the anolyte from the chlorine disengager was measured at 150 liters per minute. The gas fraction of the electrolyte in the upper section of the anode was typically less than 15 percent and pressure fluctuations were typically less than 1 centimeter in amplitude.

The novel electrode of the present invention having a height to thickness ratio of 50:1 generated a low fraction of gas in the upper portion of the anode compartment indicating efficient gas disengagement while minimizing pressure fluctuations at high rates of fluid flow through the electrode chamber.

What is claimed is:

1. An electrode for a monopolar filter press cell which comprises:

(a) a first foraminous surface and a second foraminous surface positioned in parallel and spaced apart;

(b) a frame having two side members, a top member and a bottom member attached to said first foraminous surface and said second foraminous surface;

(c) a chamber formed between said first foraminous surface and said secon foraminous surface and bounded by said frame;

(d) at least one pair of conductor rods entering said chamber through openings in one of said side members of said frame, one of said pair of conductor rods being attached only to said first foraminous surface and the other of said pair of conductor rods being attached only to said second electrode surface, each conductor rod having a lead portion outside of said chamber suitable for attachment to a current supply means and a support portion inside said chamber for said attachment to said electrode surface; said openings being substantially centered in said side frame member, and said support portion of each of said conductor rods being bent toward said electrode surface to which said conductor rod is attached; and (e) inlets and outlets in said frame for introducing fluids into and removing electrolysis products from said chamber.

2. The electrode of claim 1 in which the height of said electrode is from about 1 to about 5 meters.

3. The electrode of claim 2 in which from about 2 to about 12 pairs of conductor rods are attached to said first and said second electrode surfaces.

4. The electrode of claim 3 in which each said pair of conductor rods are positioned substantially opposite each other.

5. The electrode of claim 3 in which one of said pair of conductor rods is positioned a spaced distance above the other conductor rod.

6. The electrode of claim 4 or claim 5 in which said support portion of said conductor rod is substantially horizontal.

7. The electrode of claim 4 or claim 5 in which said support portion is sloped at from about 2° to about 10° from the horizontal.

8. The electrode of claim 6 in which one of said pair of conductor rods is above and spaced apart a distance of from about 0.025 to about 0.100 meters from the other of said pair.

9. The electrode of claim 8 in which the ratio of height to thickness of said electrode is from about 20:1 to about 50:1.

10. In a monopolar filter press cell for the electroylsis of salt solutions having a plurality of anodes and cathode alternatingly interleaved and a cation exchange membrane between each anode and each cathode, the improvement which comprises employing as anodes the electrode of claim 9.

11. In a monopolar filter press cell for the electroylsis of salt solutions having a plurality of anodes and cathodes alternatingly interleaved and a cation exchange membrane between each anode and each cathode, the improvement which comprises employing as the cathodes the electrode of claim 9.

* * * * *